US009295327B2

(12) United States Patent
Erickson et al.

(10) Patent No.: US 9,295,327 B2
(45) Date of Patent: Mar. 29, 2016

(54) SIDE MOUNTED DRAWER SLIDE

(71) Applicant: Haworth, Inc., Holland, MI (US)

(72) Inventors: Cory Erickson, Big Rapids, MI (US); Charlie Schalk, Stanwood, MI (US); Jeremy Jackson, Big Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 14/462,647

(22) Filed: Aug. 19, 2014

(65) Prior Publication Data

US 2016/0051050 A1 Feb. 25, 2016

(51) Int. Cl.
*A47B 88/04* (2006.01)
*A47B 88/16* (2006.01)

(52) U.S. Cl.
CPC ..... *A47B 88/04* (2013.01); *A47B 88/0422* (2013.01); *A47B 88/16* (2013.01); *A47B 2088/0425* (2013.01)

(58) Field of Classification Search
CPC ..... A47B 88/04; A47B 88/16; A47B 88/0422
USPC ..... 312/257.1, 334.1, 334.4, 334.7, 334.8, 312/330.1, 351, 334.44; 248/220.21, 248/220.41, 220.42, 248
See application file for complete search history.

(56) References Cited

U.S. PATENT DOCUMENTS 1,504,522 A * 8/1924 Sherer ..... A47F 3/12 108/102
2,686,704 A * 8/1954 Wolters ..... 312/257.1
2,815,649 A * 12/1957 Di Angelus et al. ..... 312/408
2,911,276 A * 11/1959 Hiers ..... 312/350
3,203,749 A 8/1965 Bullock et al.
4,193,649 A * 3/1980 Sharon ..... A47B 88/0407 248/243
4,440,461 A * 4/1984 Powell et al. ..... 312/334.8
4,681,289 A * 7/1987 Gronlund ..... A47B 88/044 248/201
4,681,381 A 7/1987 Sevey
4,792,195 A * 12/1988 Adriaansen et al. ..... 312/245
5,470,143 A * 11/1995 Gill ..... 312/334.4
5,904,412 A 5/1999 Lammens
5,927,838 A * 7/1999 Hellman, Jr. ..... 312/257.1
6,123,402 A 9/2000 Bowyer et al.
6,619,772 B2 9/2003 Dierbeck
7,014,155 B1 * 3/2006 Schnabel et al. ..... 248/224.8
7,086,708 B2 * 8/2006 Tseng ..... A47B 88/04 312/334.1
7,306,300 B2 12/2007 Kish et al.
7,722,139 B1 5/2010 Chen et al.
7,744,176 B2 6/2010 Milligan
8,157,230 B2 * 4/2012 Krueger ..... A47B 96/068 248/220.43
8,251,465 B2 8/2012 Yu et al.
2008/0315741 A1 12/2008 Huang et al.
2012/0013235 A1 1/2012 Hisamatsu

* cited by examiner

*Primary Examiner* — James O Hansen
(74) *Attorney, Agent, or Firm* — Warner Norcross & Judd LLP

(57) ABSTRACT

An improved drawer slide is provided. The drawer slide includes a plurality of retention tabs that allow the drawer slide to be repositionable among a plurality of positions in a furniture unit, generally without the use of tooling. The plurality of retention tabs includes upper and lower retention tabs. The upper retention tabs extend horizontally and upwardly. The lower retention tabs extend horizontally in vertical alignment with the upper retention tabs. The upper and lower retention tabs are shaped for insertion into respective upper and lower slots in a vertical panel. The end user can reposition the drawer slide into additional slots as desired, providing enhanced flexibility and customization over existing constructions.

14 Claims, 5 Drawing Sheets

SIDE MOUNTED DRAWER SLIDE

BACKGROUND OF THE INVENTION

The present invention relates to office furniture and, more particularly, to side mounted drawer slides for office furniture.

Many office furniture constructions include side mounted drawers. Side mounted drawers typically include rollers or rails that are received within left and right drawer slides. Selection of a particular drawer slide can depend on the application at hand. For example, some office furniture constructions benefit from the simplicity and robustness of a one-part drawer slide. Other office furniture constructions benefit from a multi-part drawer slide to permit the drawer to be more fully extended.

In addition to drawers, some office furniture constructions include shelves between opposing vertical panels. In these constructions, the opposing vertical panels can sometimes include slots for receiving shelf clips therein. The shelves are supported on these shelf clips at designated locations above or below the drawers.

In the above described constructions, drawers and shelves are typically located in pre-designated locations between opposing vertical panels. For example, in many instances the drawers are mounted between opposing panels at one height, while the shelves are mounted between opposing panels at a different height. In these constructions, the user has no input on the placement of the drawers and the shelves, and is limited by the locations designated by the manufacture without regard to the preferences of the end user.

SUMMARY OF THE INVENTION

An improved drawer slide for a side mounted drawer is provided. The drawer slide generally includes a plurality of retention tabs that allow the drawer slide to be repositionable among a plurality of positions in a furniture unit, generally without the use of tooling. For example, the drawer slide can be mounted in the same space or cavity as shelving. In use, an end user can reposition the drawer slide as desired, providing enhanced flexibility and customization over existing constructions.

In one embodiment, the drawer slide includes an elongated channel, proximal upper and lower retention tabs, and distal upper and lower retention tabs. The upper retention tabs extend laterally outward from the elongated channel before bending upwardly. The lower retention tabs extend laterally outward from the elongated channel in vertical alignment with respective upper retention tabs. The upper and lower retention tabs are shaped for insertion into respective upper and lower slots in a vertical panel, wherein the upper and lower slots are configured to also support shelf clips therein.

In another embodiment, the elongated channel, the upper retention tabs, and the lower retention tabs form a shaped metal construction, such that the drawer slide includes a unitary element. The elongated channel is shaped to receive drawer rollers or a drawer rail therein. The upper and lower retention tabs are stamped from the elongated channel, having been shaped to extend laterally outward and away from the interior of the elongated channel. The drawer slide optionally includes a bent flange to limit travel of the drawer rollers or the drawer rail along the elongated channel.

In another embodiment, a modular furniture system is provided. The modular furniture system includes first and second sidewalls that are spaced apart from each other. The first and second sidewalls include slots arranged in a plurality of columns to interchangeably receive side-mounted drawer slides and shelf clips therein. The drawer slides include a corresponding number of retention tab pairs, with each retention tab pair including an upper retention tab and a lower retention tab. The upper retention tabs are bent horizontally and upwardly, while the lower retention tabs are bent horizontally. The upper and lower retention tabs secure the side-mounted drawer slides to the desired slots in the first and second sidewalls. Once the drawer slides are in the desired position, the drawer slides are able to receive rollers or rails to guide movement of a side-mounted drawer.

These and other advantages and features of the invention will be more fully understood and appreciated by reference to the description of the current embodiments and the drawings.

DESCRIPTION OF THE CURRENT EMBODIMENTS

Figure 1:
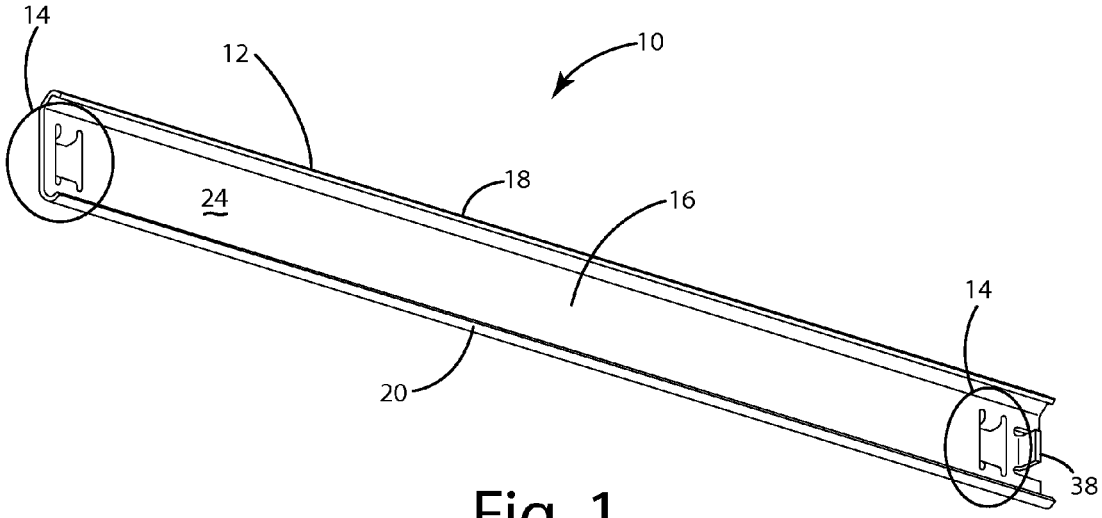
FIG. 1 is a perspective view of a drawer slide in accordance with one embodiment of the present invention.

The current embodiments relate to an improved drawer slide for a side-mounted drawer. In these embodiments, the improved drawer slide can allow pull-out drawers to be repositionable in various positions, optionally in conjunction with the repositioning of one or more shelves.

Referring now to FIGS. 1-4, an improved drawer slide in accordance with one embodiment is illustrated and generally designated 10. The improved drawer slide 10 includes an elongated channel 12 and a plurality of retention tabs 14. The elongated channel 12 is shaped to receive a drawer slide element therein, optionally drawer rollers or a drawer rail. The elongated channel 12 includes a central member 16, an upper flange 18, and a lower flange 20 that collectively define a raceway for the drawer slide element. The upper flange 18 and the lower flange 20 are integrally formed with the central member 16 in the illustrated embodiment, optionally forming a unitary sheet metal construction. The upper and lower flanges 18, 20 terminate at a free end that curve toward each other to define a generally C-shaped cross-section.

Figure 2:
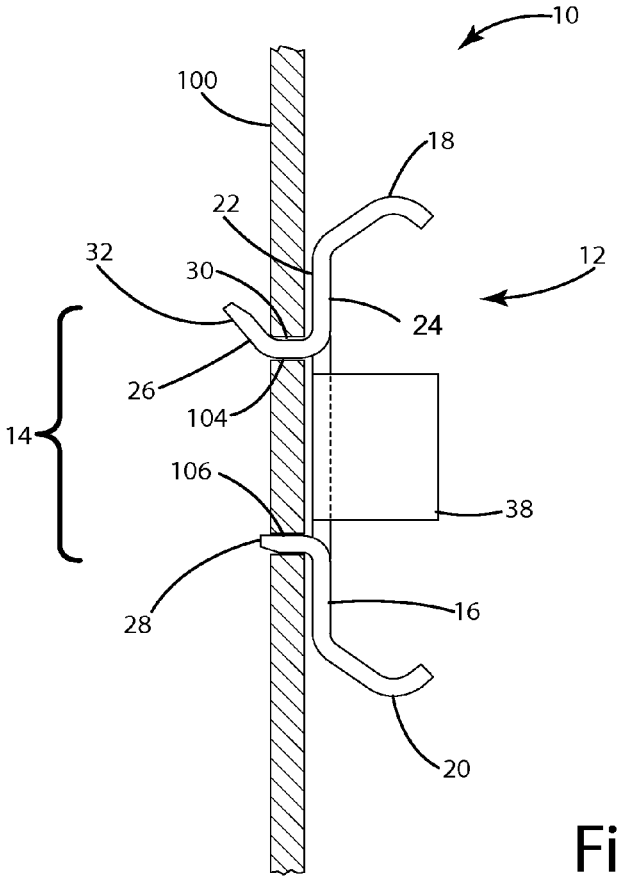
FIG. 2 is an elevation view of the proximal end of the drawer slide of FIG. 1.

As shown in FIG. 2, the central member 16 of the elongated channel 12 includes an outer major surface 22 facing a vertical panel 100 and an inner major surface 24 facing away from the vertical panel 100. The retention tabs 14 are received within a corresponding plurality of slots 102 in the vertical panel 100, shown in FIG. 5. The slots 102 include an upper slot 104 defining a through-hole through the vertical panel 100, and a lower slot 106 defining a through-hole through the vertical panel 100. In corresponding fashion, the plurality of retention tabs 14 include an upper retention tab 26 extending into and through the upper slot 104 and a lower retention tab 28 extending into and optionally through the lower slot 106.

Figure 3:
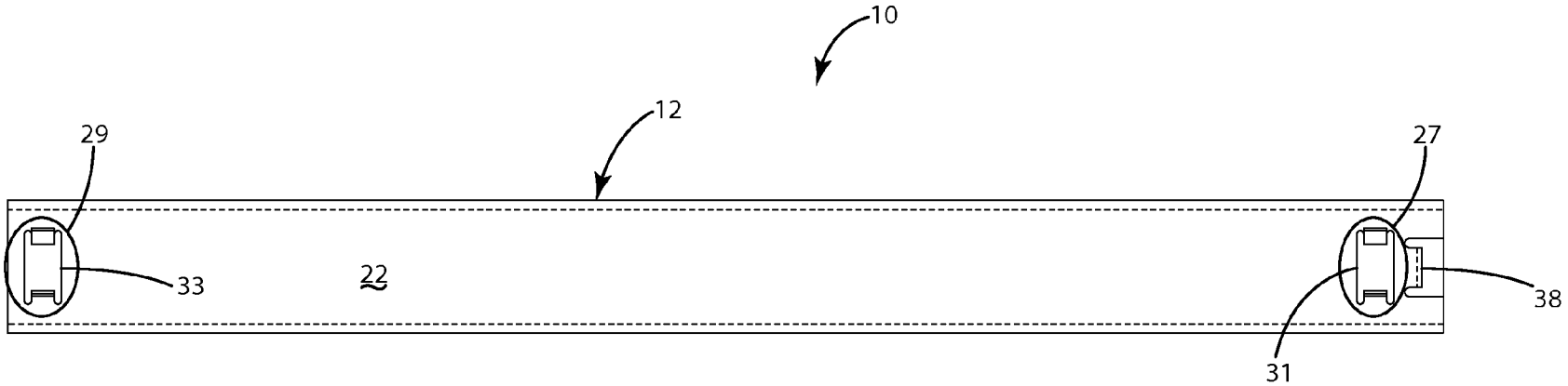
FIG. 3 is a side elevation view of the drawer slide of FIG. 1.
Figure 4:
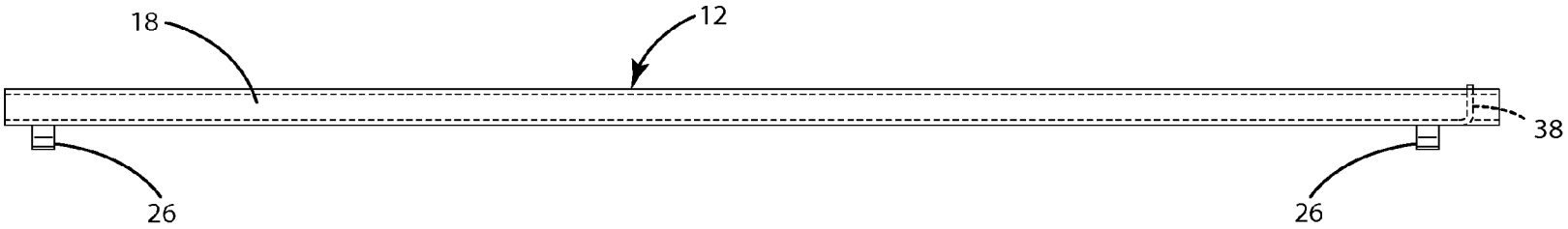
FIG. 4 is a top elevation view of the drawer slide of FIG. 1.

As shown in FIG. 3, proximal and distal retention tab pairs 27, 29 are generally formed from H-shaped cutouts 31, 33 in the central member 16. Each retention tab pair 27, 29 includes an upper retention tab 26 and a lower retention tab 28. The upper retention tab 26 includes a first segment 30 and a second segment 32 as viewed from the side in FIG. 2. The first segment 30 is bent generally horizontally from the central member 16, and the second segment 32 angles upwardly from the first segment 30. The second segment 32 is bent upwardly at approximately a forty-five degree angle (with respect to horizontal) in the present embodiment, but can be bent upwardly at essentially any angle (with respect to horizontal) that would permit the insertion of the upper retention tab 26 into the upper slot 104. As further shown in FIG. 2, the second segment 32 is a continuous extension of the first segment 30, and the first segment 30 is a continuous extension of the central member 16, such that upper retention tab 26 is defined by a generally curved J-shaped cross-section having the same or nearly the same thickness of the central member 16. In other embodiments, however, the upper retention tab 26 is first formed and then joined to the central member 16, optionally being welded thereto according to known welding techniques.

As noted above, the upper retention tab 26 is a continuous extension of the central member 16. Similarly, the lower retention tab 28 is a continuous extension of the central member 16. The lower extension tab 28 is bent horizontally from the central member 16, defining a thickness generally equal to the thickness of the central member 16. The lower retention tab 28 extends entirely through the lower slot 106 in the illustrated embodiment, while in other embodiments the lower retention tab 28 extends only partially through a horizontal opening in the vertical panel 100. The lower retention tab 28 is in vertical alignment with the upper retention tab 26, being spaced apart therefrom by a distance generally equal to the distance separating the upper and lower slots 104, 106. To join the drawer slide 10 to the vertical panel 100, the second segment 32 of the upper retention tab 26 is first guided into the upper slot 104, and the first segment 30 of the upper retention tab 26 and the lower retention tab 28 are then drawn into engagement with respective upper and lower slots 104, 106. Removal of the drawer slide 10 is performed in the reverse order, such that tooling is not required (but can be used if desired) during installation and removal.

Figure 5:
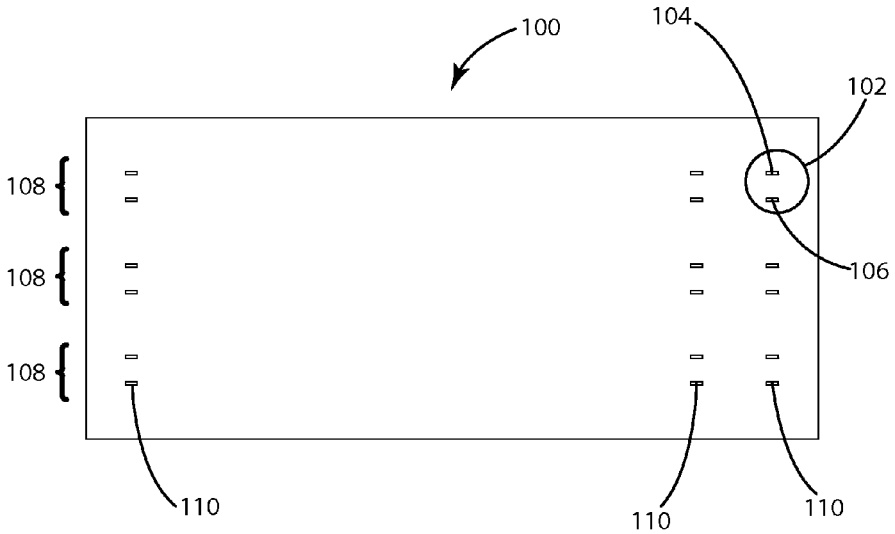
FIG. 5 is a side elevation view of a wall panel including a plurality of slots for retaining the drawer slide of FIG. 1.
Figure 6:
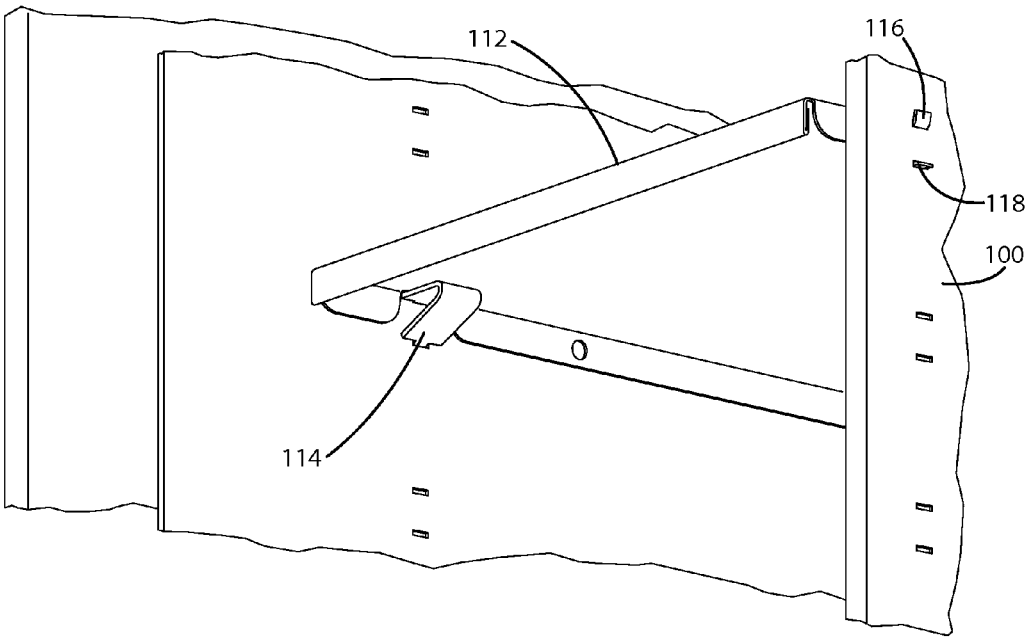
FIG. 6 includes a perspective view of a shelf mounted to the vertical panel of FIG. 5.

To reiterate, the drawer slide 10 includes a plurality of retention tab pairs. For example, the drawer slide 10 includes a proximal retention tab pair 27 and a distal retention tab pair 29. Additional retention tab pairs can be included in other embodiments where desired. Each retention tab pair includes an upper retention tab 26 and a lower retention tab 28. As generally discussed above, the upper retention tab 26 is in vertical alignment with the lower retention tab 28. In addition, the proximal retention tab pair 27 is in horizontal alignment with the distal retention tab pair 29. The vertical panel 100 generally includes slots 102 arranged in a plurality of substantially horizontal rows 108 and substantially vertical columns 110. This pattern can vary from application to application as desired, and can include additional rows and/or additional columns as generally illustrated in FIG. 5. The overall quantity of slots as well as the shape and depth of the slots can vary to accommodate, for example, drawer slides of different sizes, as well as shelf clips 112 discussed below in connection with FIG. 6. For example, the slots 102 can be shaped to accommodate shelf clips 114 now known or hereinafter developed, including shelf clips 112 received within one, two, or more slots 102. In this regard, the drawer slide 10 can be mounted in the same space or cavity as shelving 114, optionally sharing the same combination of an upper retention tab 116 and a lower tab 118 as shown in FIG. 6. In these and other constructions, an end user can reposition or swap shelves 114 and drawers 120 to provide enhanced flexibility and customization.

Referring again to FIGS. 1-4, the central member 16 can additionally include a stop 38. The stop 38 is essentially any element that limits travel of a drawer slide element along the channel raceway. In the illustrated embodiment, the stop 38 is a projection extending from the central member 16. In particular, the stop 38 is a projection that is bent horizontally from the central member 16 such that the stop 38 protrudes into the portion of the raceway that is otherwise traversed by a drawer slide element. While the stop 38 is illustrated as an integral extension of the central member 16, the stop 38 can alternatively include a separate element joined to the inner major surface 24 of the central member 16.

Figure 7:
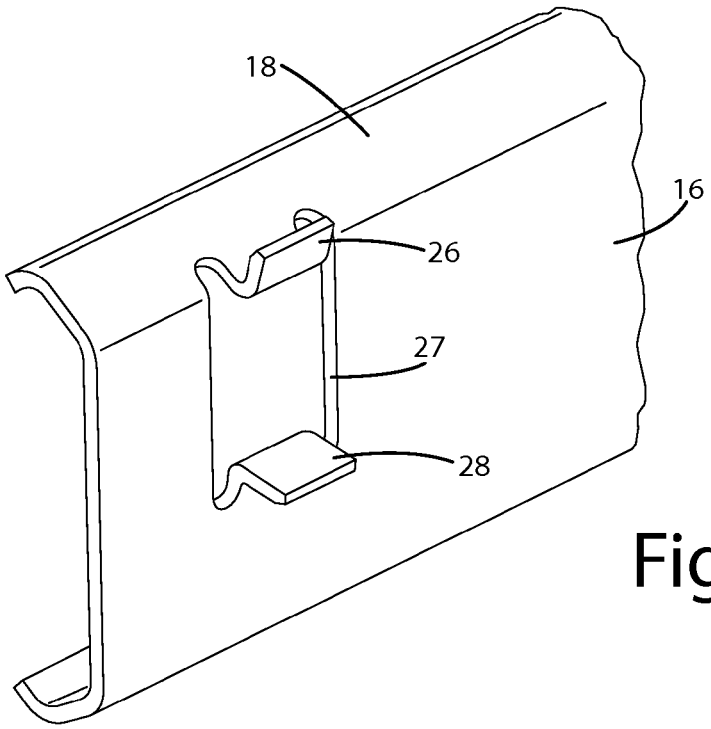
FIG. 7 is a perspective view of a drawer slide in accordance with another embodiment of the present invention.
Figure 8:
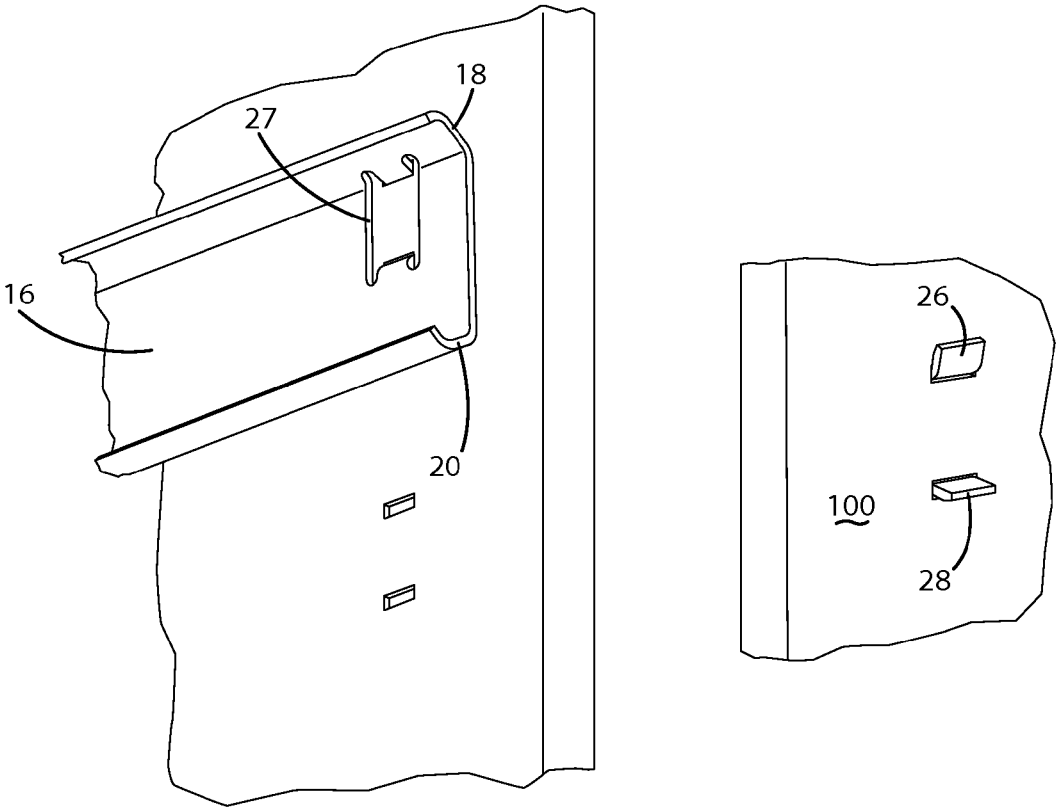
FIG. 8 includes front and rear perspective views of the drawer slide of FIG. 7 mounted to a vertical panel.

As noted above, the drawer slide 10 can be formed from a shaped metal element having upper and lower retention tabs 18, 20 formed from one or more cutouts 31, 33 in the elongated channel 12. The cutouts 31, 33 are formed in a generally planar central member 16 in FIGS. 1-4, being entirely delimited from the upper and lower flanges 18, 20, which project at an angle with respect to the central member 16. In other embodiments, however, the cutouts 31, 33 extend into one or more of the upper and lower flanges 18, 20. In FIGS. 7-8, for example, the cutouts 31, 33 are partially formed in the central member 16 and partially formed in the upper flange 18. The drawer slide 10 of FIGS. 7-8 is otherwise identical in structure and function to the drawer slide 10 of FIGS. 1-4. In particular, the upper retention tab 26 includes a first segment 30 that extends generally horizontally, and a second segment 32 that angles upwardly from the first segment 30. In similar fashion, the lower extension tab 28 extends generally horizontally, being in vertical alignment with the upper extension tab 26.

Figure 9:
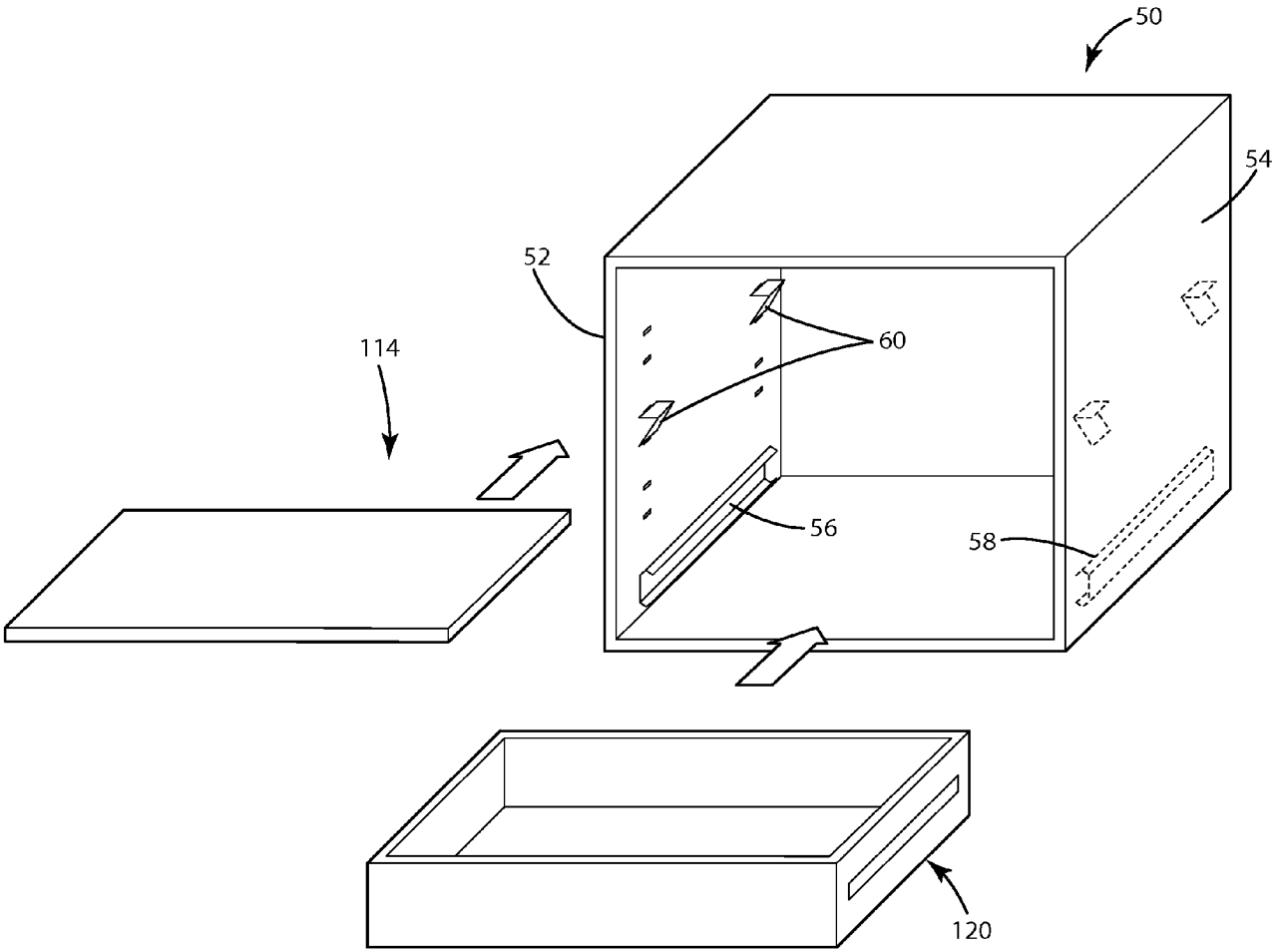
FIG. 9 is a perspective view of a modular furniture system including the drawer slide of FIG. 1 mounted between left and right vertical panels.

The above embodiments of the present invention therefore provide a drawer slide for a modular furniture system in which side-mounted drawers can be repositioned as desired. As shown in FIG. 9 for example, the modular furniture system 50 can include first and second sidewalls 52, 54 that are spaced apart from each other to define a drawer-receiving space therebetween. The first and second sidewalls 52, 54 include a plurality of retention slots 102 arranged in columns and/or rows, wherein at least two of the plurality of retention slots 102 include an upper retention slot and a lower retention slot. The modular furniture system 50 additionally includes first and second drawer slides 56, 58 that are positionable against respective first and second sidewalls 52, 54. The first and second drawer slides 56, 58 are substantially as described above in connection with the drawer slides of FIGS. 1-4 and 7-8. In particular, the drawer slides 56, 58 include an elongated channel and proximal and distal pairs of retention tabs. The proximal and distal pairs of retention tabs each include an upper retention tab and a lower retention tab for insertion into an upper retention slot and a lower retention slot in the corresponding wall panel 52, 54. The modular furniture system 50 additionally includes a sliding drawer 120 supported between the first and second drawer slides, wherein the sliding drawer 120 and the first and second drawer slides 56, 58 are repositionable at multiple positions in the drawer-receiving space. As optionally shown in FIG. 9, a shelf 114 is optionally supported by shelf clips 60 that share the same plurality of retention slots as do the drawer slides 56, 58. In this regard, the end user can reposition the drawer slide 56, 58 and the shelf 114 within the drawer-receiving space as desired.

The drawer slide 10 can be made of any suitable material, including for example steel, aluminum, or plastic. Where metal materials are used, the drawer slide 10 can be formed by stamping, roll forming, or die casting, for example. Where plastic materials are used, the drawer slide 10 can be formed by extrusion and molding processes. While described above as relating to a one-part drawer slide assembly, the drawer slide 10 can be implemented as a multi-part drawer slide assembly. For example, the drawer slide 10 can form part of a two-part drawer slide assembly or a three-part drawer slide assembly, thereby permitting the drawer to be more fully retracted from an enclosure. In these and other constructions, the drawer slide 10 limits the side-to-side movement of the drawer, providing lateral stability in the retracted drawer position and in the extended drawer position.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. Any reference to elements in the singular, for example, using the articles "a," "an," "the," or "said," is not to be construed as limiting the element to the singular.

The invention claimed is:

1. A drawer slide for mounting a sliding drawer to a wall panel having an upper slot and a lower slot, the drawer slide comprising:

an elongated channel including a central member, an upper flange, and a lower flange;

an upper retention tab and a lower retention tab defined by a cutout in the central member, the upper retention tab including a horizontal segment and an angled segment for placement into the upper slot, the lower retention tab extending horizontally for placement into the lower slot;

wherein the upper and lower retention tabs are in vertical alignment with each other to retain the elongated channel in position with respect to the wall panel, and wherein the angled segment of the upper retention tab is oriented at an upwardly-sloped angle with respect to the horizontal segment of the upper retention tab such that the angled segment extends outwardly as it extends upwardly, and wherein the horizontal segment and the angled segment are planar along their respective lengths and define a thickness generally equal to a thickness defined by the central member.

2. The system of claim 1 wherein the upper and lower retention tabs and the elongated channel are formed of a shaped metal element.

3. The system of claim 1 wherein the upper and lower retention tabs are a proximal retention tab pair and further including a distal retention tab pair.

4. A drawer slide for attachment to a sidewall, the drawer slide comprising:

an elongated channel; and first and second H-shaped cutouts in the elongated channel to define respective first and second retention tab pairings, the first and second retention tab pairings including:

an upper retention tab extending from the elongated channel and including a horizontal segment and an angled segment, and a lower retention tab extending from the elongated channel, wherein the upper and lower retention tabs are in vertical alignment with each other for insertion into respective upper and lower slots in the sidewall, wherein the angled segment of the upper retention tab is oriented at an upwardly-sloped angle with respect to the horizontal segment of the upper retention tab such that the angled segment extends outwardly as it extends upwardly, and wherein the angled segment of the upper retention tab is planar along its length and defines a thickness generally equal to the thickness defined by the elongated channel to retain the upper retention tab in the upper slot in the sidewall.

5. The drawer slide of claim 4 further including a stop to limit travel of a sliding drawer in the elongated channel.

6. The drawer slide of claim 5 wherein the stop extends in a direction opposite of the upper and lower tabs.

7. The drawer slide of claim 5 wherein the stop is integrally formed with the elongated channel.

8. A modular furniture system comprising:

first and second sidewalls spaced apart from each other to define a drawer-receiving space therebetween, each of the first and second sidewalls including distal upper and lower slots and proximal upper and lower slots;

first and second drawer slides positionable against respective first and second sidewalls, the first and second drawer slides including:

an elongated channel including a central member defining a thickness and including an upper flange and a lower flange spaced apart from each other to define a raceway for a drawer slide element, proximal and distal upper retention tabs that include a horizontal segment and an angled segment for placement into the proximal and distal upper slots, the angled segment being oriented at an upwardly-sloped angle with respect to the horizontal segment such that the angled segment extends outwardly as it extends upwardly, and proximal and distal lower retention tabs that extend horizontally for placement into the proximal and distal lower slots, wherein the proximal upper retention tab and the proximal lower retention tab are defined by a common proximal H-shaped cutout in the elongated channel, and wherein the distal upper retention tab and the distal lower retention tab are defined by a common distal H-shaped cutout in the elongated channel, wherein the elongated channel includes a proximal cutaway extending from the proximal upper retention tab to the proximal lower retention tab and includes a distal cutaway extending from the distal upper retention tab to the distal lower retention tab; and a sliding drawer supported between the first and second drawer slides, the sliding drawer and the first and second drawer slides being repositionable at a plurality of positions between the first and second sidewalls, wherein the angled segment of the proximal and distal upper retention tabs are planar along their respective lengths and define a thickness generally equal to the thickness defined by the central member of the elongated channel.

9. The system of claim 8 wherein the elongated channel, the upper retention tabs, and the lower retention tabs form a unitary member.

10. The system of claim 8 wherein the elongated channel includes a stop to limit travel of the sliding drawer.

11. The system of claim 8 wherein the lower retention tabs are generally flat to generally correspond with the lower slots.

12. The system of claim 8 wherein the distal upper and lower slots and the proximal upper and lower slots are rectangular.

13. The system of claim 8 wherein the distal upper and lower slots and the proximal upper and lower slots are adapted to receive a shelf clip therein.

14. The system of claim 8 wherein the first and second sidewalls each include a plurality of distal upper and lower slots and proximal upper and lower slots to allow for positioning of the first and second drawer slides at a plurality of height positions.

* * * * *